US008554125B2

(12) United States Patent
Nukumi

(10) Patent No.: US 8,554,125 B2
(45) Date of Patent: Oct. 8, 2013

(54) IMAGE FORMING DEVICE AND IMAGE FORMING METHOD WHICH PREVENTS MISALIGNMENT BETWEEN FRONT END OF FORMED IMAGE AND FRONT END OF SHEET

(75) Inventor: Hideyuki Nukumi, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 374 days.

(21) Appl. No.: 12/725,070

(22) Filed: Mar. 16, 2010

(65) Prior Publication Data

US 2010/0239343 A1 Sep. 23, 2010

(30) Foreign Application Priority Data

Mar. 17, 2009 (JP) ..... 2009-064602

(51) Int. Cl.
*G03G 15/00* (2006.01)

(52) U.S. Cl.
USPC ..... 399/394; 399/389

(58) Field of Classification Search
CPC ..... B65H 9/006
USPC ..... 399/388, 389, 394
See application file for complete search history.

(56) References Cited

U.S. PATENT DOCUMENTS 7,058,318 B2 * 6/2006 Nakahara ..... 399/16
2002/0039507 A1 * 4/2002 Kawasumi et al. ..... 399/388
2004/0253030 A1 * 12/2004 Hamada et al. ..... 399/367
2006/0239731 A1 * 10/2006 Suzuki et al. ..... 399/389

FOREIGN PATENT DOCUMENTS

| | | |
|---|---|---|
| JP | 62-12550 | 1/1987 |
| JP | 8-6332 | 1/1996 |
| JP | 11-59954 | 3/1999 |
| JP | 2001-134038 | 5/2001 |
| JP | 2001-142373 | 5/2001 |
| JP | 2005-91740 | 4/2005 |
| JP | 2006-227318 | 8/2006 |

OTHER PUBLICATIONS

Japanese Decision to Grant a Patent mailed Feb. 1, 2011, directed to counterpart Japanese Application No. 2009-064602; 4 pages.

* cited by examiner

*Primary Examiner* — Ren Yan
*Assistant Examiner* — Blake A Tankersley
(74) *Attorney, Agent, or Firm* — Morrison & Foerster LLP

(57) ABSTRACT

An image forming device makes a sheet pass between first rotating member and separator in a pressed position, causes second rotating member pair to transport a sheet, transports the sheet from second rotating member pair with the sheet held between third rotating member and image carrier in a transfer position, transfers an image formed on image carrier onto the sheet, and suspends rotation of first rotating member when a portion of the sheet, which is distance L away from the sheet's rear end, passes the pressed position. Provided that length 1≥(M+L) and length 2<(M+L) where M is a distance from the pressed position to the transfer position, when the sheet has length 2 in a transport direction, the device delays image formation start and/or advances sheet transport start, by a predetermined time period as compared to when the sheet has length 1 in the transport direction.

5 Claims, 7 Drawing Sheets

<When A3 sheet is used>

FIG. 3A

Start of feeding

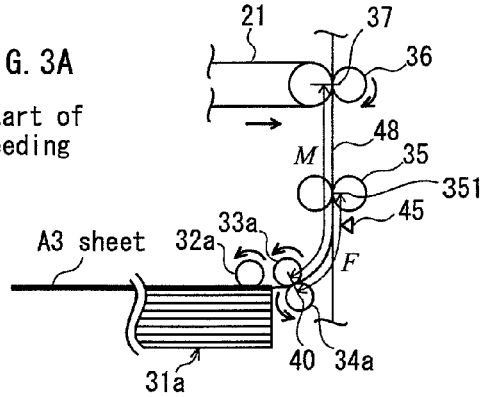

FIG. 3B

Formation of curve

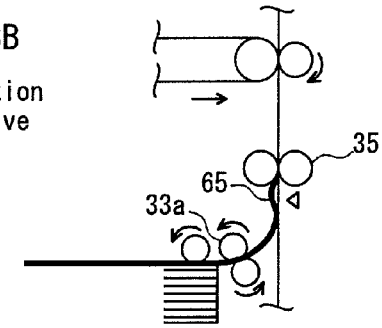

FIG. 3C

Sheet is transported

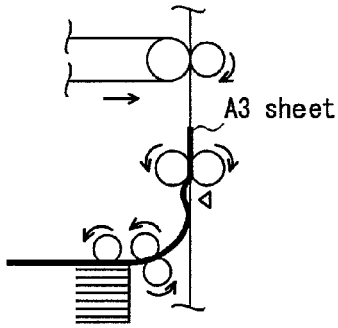

FIG. 3D

Rotation of feed roller 33a is suspended

↓

Transportation load applied to registration rollers 35 is small

↓

Sheet slip does not occur

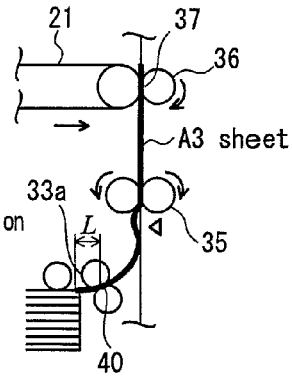

<When A4 sheet is used>

FIG. 3E

Start of feeding

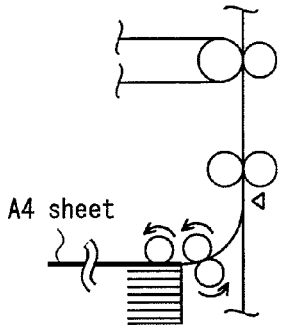

FIG. 3F

Formation of curve

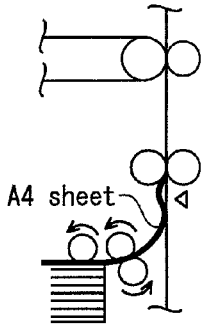

FIG. 3G

Rotation of feed roller 33a is suspended

↓

Transportation load applied to registration rollers 35 is large

↓

Sheet slip occurs

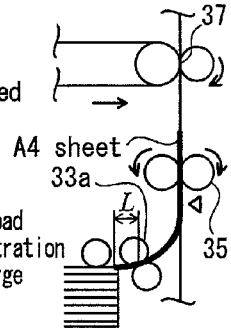

FIG. 4

59

| Sheet size | Write start time |
|---|---|
| A3 | Standard |
| A4 | Delayed by *te* (seconds) |

591

| Sheet size | Registration start time |
|---|---|
| A3 | Standard |
| A4 | Advanced by *te* (seconds) |

IMAGE FORMING DEVICE AND IMAGE FORMING METHOD WHICH PREVENTS MISALIGNMENT BETWEEN FRONT END OF FORMED IMAGE AND FRONT END OF SHEET

This application is based on an application No. 2009-064602 filed in Japan, the contents of which are hereby incorporated by reference.

BACKGROUND OF THE INVENTION (1) Field of the Invention

The present invention relates to an image forming device and an image forming method for feeding sheets contained in a container one by one, and forming an image on each of the sheets that have been fed.

(2) Description of the Related Art

An image forming device (a printer, etc.) forms an image on an image carrier such as a photosensitive drum. In parallel with this operation, the image forming device causes (i) a pickup roller to pick up sheets contained in a feed cassette, (ii) a feed roller and a separator roller that is pressed against the feed roller to individually separate the sheets that have been picked up, and (iii) each of the sheets that have been individually separated to be transported via a pair of transportation rollers to a pair of abeyant registration rollers.

Although the pair of registration rollers are abeyant, the feed roller and the pair of transportation rollers keep rotating. Hence, a front end of each sheet in a transportation direction comes to a halt while being stuck in between the pair of registration rollers, whereas a rear end of the sheet is pushed along the transportation direction by the feed roller and the pair of transportation rollers. As a result, a certain curve is formed in the sheet in the vicinity of its front end. This curve is formed to correct a skew of the sheet.

Rotation of the pair of registration rollers is started at a predetermined time, due to which the following times coincide with each other: (i) a time at which the front end of the sheet arrives at a transfer position on the image carrier after the rotation of the pair of registration rollers has been started; and (ii) a time at which a front end of the image formed on the image carrier arrives at the transfer position. Due to the rotation of the pair of registration rollers, the sheet is transported toward the transfer position. In the transfer position, a transfer roller is pressed against the image carrier. While the sheet is held between and transported by the image carrier and the transfer roller in the transfer position, the image on the image carrier is transferred onto the sheet with the front end of the image and the front end of the sheet aligned with each other.

In the field of image forming devices, there has been strong demand for image forming devices that are smaller in size and require less manufacturing costs. One way to meet such demand is to structure an image forming device in which a feed roller and a pair of registration rollers are arranged on a transportation path. This image forming device is different from the above-described image forming device in which the feed roller, the pair of transportation rollers and the pair of registration rollers are arranged in this order on the transportation path. As the image forming device with no pair of transportation rollers requires a shorter transportation path, it can be manufactured smaller in size. Furthermore, as this image forming device does not include the pair of transportation rollers, it can be manufactured at lower manufacturing costs as well.

However, the image forming device with no pair of transportation rollers may cause delay in transportation of a sheet depending on a size of the sheet, for the following reason.

When a sheet is being transported, the feed roller rotates along with the pair of registration rollers to facilitate the transportation of the sheet. However, the rotation of the feed roller is suspended shortly before the rear end of the sheet passes the feed roller. The purpose of thus suspending the rotation of the feed roller during the transportation of the sheet is to prevent multiple transportation whereby more than one sheets are transported at a time.

More specifically, if the feed roller keeps rotating after the rear end of a first sheet has passed the feed roller, then there is a higher chance that the feed roller feeds a second sheet, which had been separated from the first sheet by the separator roller, with almost no gap between the rear end of the first sheet and the front end of the second sheet (i.e., multiple transportation). In order to prevent the first and second sheets from being fed in close succession, rotation of the feed roller is mandatorily suspended when a certain portion of the first sheet passes the feed roller, the certain portion being away from the rear end of the first sheet by a predetermined distance L (approximately 10 [mm]) in the transportation direction.

Once the rotation of the feed roller has been suspended, transportation load (a brake) is applied to the rear end of the first sheet, the transportation load originating from the force of pressure between the feed roller and the separator roller. At the same time, the front end of the first sheet is pulled toward the transportation direction due to rotation of the pair of registration rollers. Consequently, the curve formed in the first sheet is released, and the first sheet is stretched to full length. At this moment, the largest transportation load is applied to the first sheet.

Assume a case where the image forming device with no pair of transportation rollers uses a sheet A having a first size whose length in the transportation direction is longer than a length (M+L), where M is a distance from the position of the feed roller to the transfer position on the transportation path, and L is the aforementioned distance L. In this case, during transportation of the sheet A, the front end of the sheet A in the transportation direction is located past the transfer position by the time the rotation of the feed roller is suspended. After the rotation of the feed roller has been suspended, the sheet A is transported by both of the pair of registration rollers and the transfer roller; therefore, the sheet A rarely slips when being held between the pair of registration rollers, even if some degree of transportation load is applied to the sheet A.

In contrast, assume a case where the image forming device with no pair of transportation rollers uses a sheet B having a second size whose length in the transportation direction is shorter than the aforementioned length (M+L). In this case, during transportation of the sheet B, the front end of the sheet B in the transportation direction is yet to arrive at the transfer position by the time the rotation of the feed roller is suspended. After the rotation of the feed roller has been suspended, the sheet B is transported only by the pair of registration rollers. In this case, transportation load is applied only to the pair of registration rollers. The moment the transportation load is also applied to the sheet B (especially, the moment the largest transportation load is applied to the sheet B due to release of the curve formed in the sheet B), the rear end of the sheet B is pulled strongly toward a direction opposite to the transportation direction. This may cause the sheet B to slip through the pair of registration rollers.

When this sheet slip occurs, the front end of the sheet B arrives at the transfer position with delay that is equivalent to an amount of the sheet slip. Thus, in the transfer position, the front end of the sheet B is misaligned with the front end of the image in the transportation direction. As a result, after the image has been transferred onto the sheet B, the image is printed on the sheet B in such a way that the image is misaligned with the sheet B.

SUMMARY OF THE INVENTION

The present invention aims to provide an image forming device that can be manufactured small in size and at low manufacturing costs, and maintain image quality by preventing misalignment between a front end of each formed image and a front end of the corresponding sheet, even when the image forming device uses sheets having different sizes. The present invention also aims to provide an image forming method used in the above image forming device.

The former aim can be achieved by an image forming device that forms an image on a rotating image carrier, comprising: a feeder operable to cause (i) a sheet to pass between a first rotating member for feeding the sheet and a separator pressed against the first rotating member in a pressed position, and (ii) a pair of second rotating members to transport the sheet fed from the first rotating member with the sheet held therebetween; a third rotating member that (i) is pressed against the image carrier in a transfer position, (ii) transports the sheet that has been transported from the pair of second rotating members, with the sheet held between the second rotating member and the image carrier, and (iii) transfers the image formed on the image carrier onto the sheet; a first controller operable to relatively control time when the image formation is started and time when the pair of second rotating members start the sheet transport toward the transfer position; and a second controller operable, during the sheet transport, to suspend rotation of the first rotating member when a portion of the sheet passes the pressed position, the portion of the sheet being away from a rear end of the sheet by a predetermined distance L, wherein provided that a length of a first sheet size in a transport direction is grater than or equal to a length (M+L), where M is a distance from the pressed position to the transfer position on a transport path, and a length of a second sheet size in the transport direction is smaller than the length (M+L), when the sheet has the second sheet size, the first controller at least one of (i) delays the start of the image formation and (ii) advances the start of the sheet transport, by a predetermined time period as compared to when the sheet has the first sheet size.

The latter aim can be achieved by an image forming method used in an image forming device that forms an image on a rotating image carrier, the method comprising: a first step of causing (i) a sheet to pass between a first rotating member for feeding the sheet and a separator pressed against the first rotating member in a pressed position, and (ii) a pair of second rotating members to transport the sheet fed from the first rotating member with the sheet held therebetween; a second step of (i) transporting the sheet that has been transported from the pair of second rotating members, with the sheet held between a second rotating member pressed against the image carrier in a transfer position and the image carrier, and (ii) transferring the image formed on the image carrier onto the sheet; a third step of relatively controlling time when the image formation is started and time when the pair of second rotating members start the sheet transport toward the transfer position; and a fourth step of, during the sheet transport, suspending rotation of the first rotating member when a portion of the sheet passes the pressed position, the portion of the sheet being away from a rear end of the sheet by a predetermined distance L, wherein provided that a length of a first sheet size in a transport direction is grater than or equal to a length (M+L), where M is a distance from the pressed position to the transfer position on a transport path, and a length of a second sheet size in the transport direction is smaller than the length (M+L), when the sheet has the second sheet size, the third step at least one of (i) delays the start of the image formation and (ii) advances the start of the sheet transport, by a predetermined time period as compared to when the sheet has the first sheet size.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 3A to 3D illustrate how an A3 sheet is transported, and FIGS. 3E to 3G illustrate how an A4 sheet is transported;

FIG. 4 shows contents of a write start time table stored in the control unit;

DESCRIPTION OF THE PREFERRED EMBODIMENT

The following describes one embodiment of an image forming device pertaining to the present invention. By way of example, the following embodiment is applied to a tandem digital color printer (hereinafter, simply "printer").

(1) Overall Structure

Figure 1:
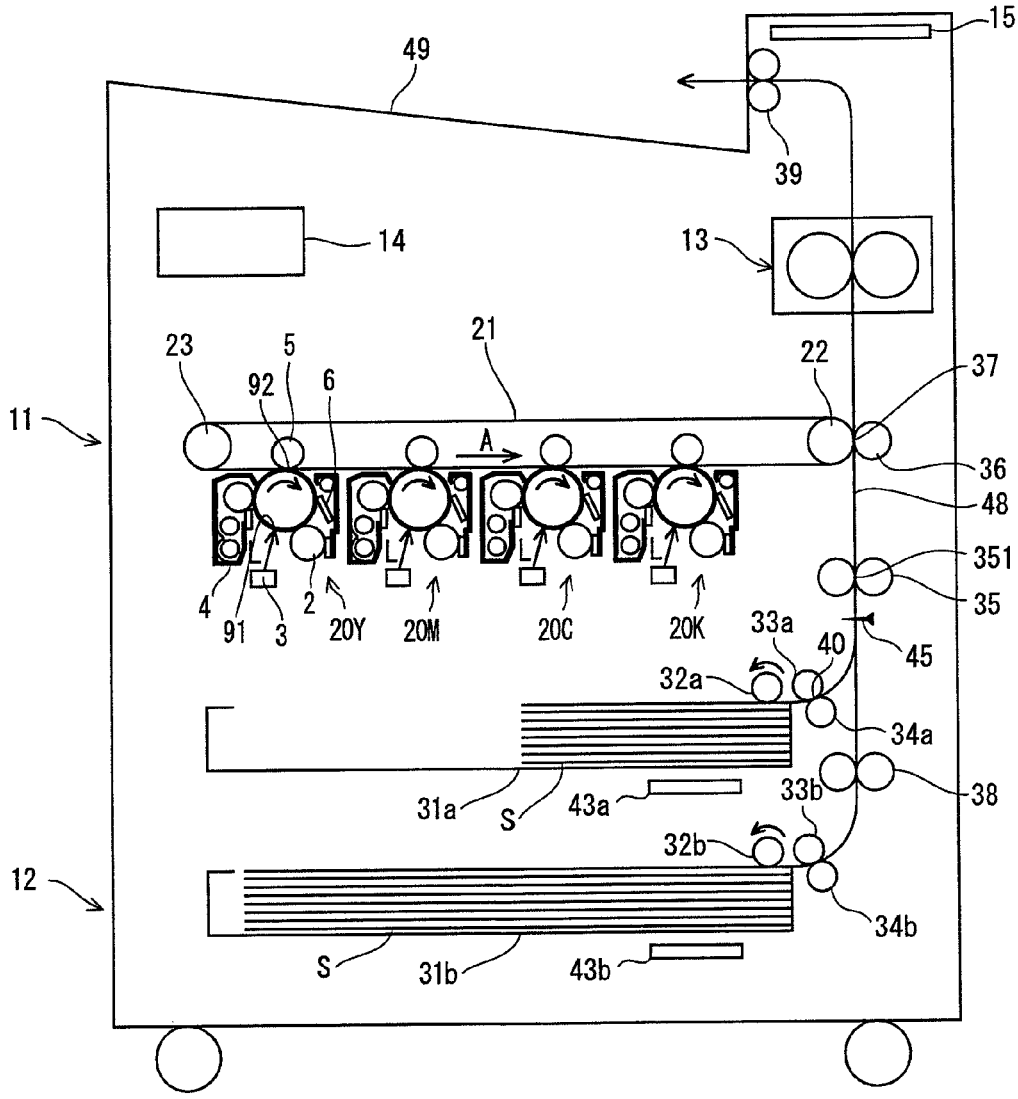
FIG. 1 shows an overall structure of a printer.

FIG. 1 shows an overall structure of a printer 10.

As shown in FIG. 1, the printer 10 is composed of an image forming unit 11, a feed unit 12, a fixing unit 13 and a control unit 14. The printer 10 is connected to a network such as LAN, and executes a print job in accordance with a job execution instruction issued by an external terminal (not illustrated).

The image forming unit 11 includes image forming subunits 20Y, 20M, 20C and 20K that respectively correspond to colors yellow (Y), magenta (M), cyan (C) and black (K), an intermediate transfer belt 21, etc.

The image forming subunits 20Y, 20M, 20C and 20K are arranged in line at a predetermined interval along the intermediate transfer belt 21. The image forming subunit 20Y includes a photosensitive drum 1, a charger 2, an exposure part 3, a developer 4, a first transfer roller 5 that faces the photosensitive drum 1 with the intermediate transfer belt 21 therebetween, a cleaner 6 for cleaning the surface of the photosensitive drum 1, etc. The charger 2, the exposure part 3, the developer 4, the first transfer roller 5 and the cleaner 6 are all located around the photosensitive drum 1. The image forming subunit 20Y forms a yellow toner image onto the photosensitive drum 1. The exposure part 3 functions as image writing means. A laser diode, a polygonal mirror, a scan lens, etc. are provided inside the exposure part 3. The polygonal mirror polarizes a laser beam emitted from the laser diode, so that the surface of the photosensitive drum 1 is exposed to and scanned by the laser beam in a main scanning direction.

Other image forming subunits 20M, 20C and 20K are fundamentally structured the same as the image forming subunit 20Y, and respectively form magenta, cyan and black toner images. Reference numbers of constituent elements of the image forming subunits 20M, 20C and 20K are omitted from FIG. 1.

The intermediate transfer belt 21 is an endless belt that is hung on a drive roller 22 and a driven roller 23. The intermediate transfer belt 21 is rotated in the direction of arrow A shown in FIG. 1.

The feed unit 12 includes feed cassettes 31*a* and 31*b*, pickup rollers 32*a* and 32*b*, feed rollers 33*a* and 33*b*, separator rollers 34*a* and 34*b*, a pair of registration rollers 35, and a secondary transfer roller 36 that is pressed against the drive roller 22 with the intermediate transfer belt 21 therebetween.

The feed cassettes 31*a* and 31*b* are containers in which recording sheets are contained. One of the feed cassettes 31*a* and 31*b* is located on top of the other. The feed cassettes 31*a* and 31*b* are structured so that sheets of various sizes can be set therein. A user can set sheets of desired sizes in the feed cassettes 31*a* and 31*b*. By way of example, FIG. 1 shows a case where A4-sized sheets S are set crosswise in the feed cassette 31*a* (so that long edges of the sheets are parallel to the rotational axes of the pickup rollers 32*a* and 32*b*), whereas A3-sized sheets S are set lengthwise in the feed cassette 31*b* (so that short edges of the sheets are parallel to the rotational axes of the pickup rollers 32*a* and 32*b*).

The pickup roller 32*a* picks up and directs each of the sheets S set in the feed cassette 31*a* toward a transportation path 48. The pickup roller 32*b* picks up and directs each of the sheets S set in the feed cassette 31*b* toward the transportation path 48.

The feed roller 33*a* feeds each of the sheets S picked up by the pickup roller 32*a* towards the pair of registration rollers 35. The separator roller 34*a* is pressed against the feed roller 33*a*. If the pickup roller 32*a* simultaneously picks up more than one sheets S that are stuck together, the separator roller 34*a* individually separates the more than one sheets, sets the topmost sheet S apart from the rest of the more than one sheets S, and causes only the topmost sheet S to pass between the feed roller 33*a* and the separator roller 34*a*. These sheet feeding and separating functions are also exerted by the pair of feed roller 33*b* and separator roller 34*b*.

Along the transportation path 48, a pair of transportation rollers 38 are located between the feed roller 33*b* and the pair of registration rollers 35. The pair of transportation rollers 38 are provided to transport each sheet S fed by the feed roller 33*b* to the pair of registration rollers 35.

Upon executing a job, one of the feed cassettes 31*a* and 31*b* is selected, and sheets are fed from the selected feed cassette. As one example, when data on the job transmitted from an external terminal specifies one of the feed cassettes that is intended to be used, the specified cassette may be the selected feed cassette. As another example, when the image forming device receives a user instruction for specifying one of the feed cassettes via an operation panel 15, the specified cassette may be the selected feed cassette.

The pair of registration rollers 35 transport each sheet S fed by the feed rollers 33*a* and 33*b*, so that each sheet S arrives at a secondary transfer position 37 at the right time. The pair of registration rollers 35 are abeyant when the front end of each sheet S in the transportation direction arrives at the pair of registration rollers 35. Rotation of the pair of registration rollers 35 is started at a predetermined time, specifics of which will be described later.

Rollers such as the feed roller 33*a* and the pair of registration rollers 35 are rotated by drive motors (not illustrated) applying drive force thereto via drive transmission mechanisms (e.g., gears). Each of the drive transmission mechanisms includes a device, such as an electromagnetic clutch, that intermittently transmits the drive force from the corresponding drive motor to the corresponding roller. Rotation of each roller can be started and suspended by turning on and off the corresponding electromagnetic clutch.

The fixing unit 13 reliably forms a fixing nip by having a fixing roller and a pressure roller pressed against each other. The fixing unit 13 also heats the fixing roller with use of a heater, and maintains the fixing roller at a temperature that is required to perform fixing (e.g., 190° C.).

The control unit 14 converts an image signal transmitted from the external terminal into digital signals that respectively correspond to colors yellow, magenta, cyan and black, and generates drive signals for rotating the laser diodes included in the exposure parts 3 of the image forming subunits 20Y, 20M, 20C and 20K. The generated drive signals respectively drive the laser diodes included in the exposure parts 3 of the image forming subunits 20Y, 20M, 20C and 20K. As a result, in each of the image forming subunits 20Y, 20M, 20C and 20K, laser light is emitted from the laser diode, and the photosensitive drum 1 is exposed to and scanned by the laser light (image writing).

In each of the image forming subunits 20Y, 20M, 20C and 20K, the photosensitive drum 1 is evenly charged by the charger 2 before being exposed to and scanned by the laser light. As a result of the photosensitive drums 1 thus getting exposed to the laser lights, electrostatic latent images of images to be ultimately formed are formed on the photosensitive drums 1. The developers 4 develop the formed electrostatic latent images by using toners.

The toner image of each color is subjected to electrostatic force that is exerted by an electric field generated between the corresponding primary transfer roller 5 and photosensitive drum 1. This causes the toner image of each color to be primary-transferred onto the intermediate transfer belt 21. Here, the toner images of the four colors are transferred onto the intermediate transfer belt 21 at different timings, so that they are located in the same position on the intermediate transfer belt 21, overlapping one another. Thereafter, the toner images of the four colors, which overlap one another on the intermediate transfer belt 21, are carried toward the secondary transfer position 37 along with rotation of the intermediate transfer belt 21.

In parallel with the above-described image formation operations, the pair of registration rollers 35 start transporting a sheet S. To be more specific, the pair of registration rollers 35 start rotating and transporting the sheet S toward the secondary transfer position 37 when a predetermined time period tc (described later) has elapsed since a write start time at which the image forming unit 11 starts image wiring. Note, the write start time has been preset as a time at which execution of image formation should be started on each of the fed sheets.

Herein, the predetermined time period tc is assumed to be a difference between $T\alpha$ and $T\beta$, or more specifically, $(T\alpha-T\beta)$. Assume a case where a latent image, which is formed on the photosensitive drum 1 in the image forming subunit 21 at the write start time, has been developed using toner, and the developed toner image has been transferred onto the intermediate transfer belt 21. In this case, Tα is a time period required for the front end of the toner image, which has been transferred onto the intermediate transfer belt 21, in a belt rotation direction to arrive at the secondary transfer position 37. Tβ is a time period required between (i) a time at which the pair of registration rollers 35 start transporting the sheet S toward the secondary transfer position 37 and (ii) a time at which the front end of the sheet S arrives at the secondary transfer position 37. Here, Tα and Tβ satisfy the relationship Tβ<Tα.

Given that the sheet slip explained in the above "(2) Description of the Related Art" section does not occur, if the rotation of the registration rollers 35 is started when the time difference (Tα−Tβ) has elapsed since the write start time, the front end of the sheet S arrives at the secondary transfer position 37 exactly when the front end of the full-color image formed on the rotating intermediate transfer belt 21 arrives at the secondary transfer position 37. Accordingly, the front end of the formed full-color image and the front end of the sheet S are aligned with each other; i.e., there is no misalignment between the formed full-color image and the sheet S in the transportation direction. The time difference (Tα−Tβ) can be determined in accordance with the device structure.

To be more specific, according to the above-described image forming device, a yellow image is the first image to be written (or, to be subjected to the exposure scanning) among all the yellow, magenta, cyan and black images. With this in mind, Tα and Tβcan be respectively obtained by using the equations Tα=(P1+P2)/V and Tβ=P3/V, where P1, P2, P3 and V are defined as follows. P1 is a distance from an exposure position 91 to a first transfer position 92 on the circumferential surface of the photosensitive drum 1 in the image forming subunit 20Y, the distance being measured along a drum rotation direction. P2 is a distance from the first transfer position 92 associated with the image forming subunit 20Y to the secondary transfer position 37 on the intermediate transfer belt 21, the distance being measured along the belt rotation direction. P3 is a distance from a nip position 351, in which the pair of registration rollers 35 are pressed against each other, to the secondary transfer position 37 along the transportation path 48. V is a system speed (the system speed is equivalent to a speed of rotation of the photosensitive drums 1, a speed of rotation of the intermediate transfer belt 21, and a speed of sheet transportation; these speeds are the same).

Once the front end of the sheet S has arrived at the secondary transfer position 37, the toner images of the four colors on the intermediate transfer belt 21 are secondary-transferred onto the sheet S collectively, while the sheet S is being held between and transported by the rotating intermediate transfer belt 21 and secondary transfer roller 36. Here, the toner images of the four colors are secondary-transferred, because they are subjected to electrostatic force that is exerted by an electric field generated between the secondary transfer roller 36 and the drive roller 22.

Once the sheet S has passed the secondary transfer position 37, the sheet S is transported to the fixing unit 13. When the sheet S passes through the fixing unit 13, the full-color toner image is fixed onto the sheet S by heat and pressure. Thereafter, the sheet S is discharged to the outside of the image forming device by a pair of discharge rollers 39, and deposited on a container tray 49.

The operation panel 15 is located in the front of the image forming device, so that a user can easily operate the operation panel 15. For example, the operation panel 15 includes the following components: buttons with which the user inputs print conditions (the number of print sets, darkness, etc.); buttons with which the user inputs sizes of sheets set in the feed cassettes 31*a* and 31*b*; and a display for displaying the sheet sizes, jamming of a sheet (a paper jam), occurrence of an error, etc.

Sheet size detection sensors 43*a* and 43*b* are located below the feed cassettes 31*a* and 31*b*, respectively. The sheet size detection sensors 43*a* and 43*b* detect sizes of sheets S set in the feed cassettes 31*a* and 31*b*, respectively. The sheet size detection sensors 43*a* and 43*b* transmit sheet size signals indicating the detected sheet sizes to the control unit 14, respectively.

A registration sensor 45 is located in the vicinity of the registration rollers 35, in such a way that the registration sensor 45 is further upstream than the registration rollers 35 in the transportation direction. The registration sensor 45 is used to detect jamming of a sheet (a paper jam) and to form a curve in a sheet (described later). The moment the front end of the sheet S heading to the registration rollers 35 passes a predetermined detection position on the transportation path 48, the registration sensor 45 instantly detects the front end of the sheet S passing the predetermined detection position, and transmits a detection signal indicating the passing of the front end of the sheet S to the control unit 14. As one example, a reflective optical sensor may be used as the registration sensor 45.

(2) Structure of Control Unit 14

Figure 2:
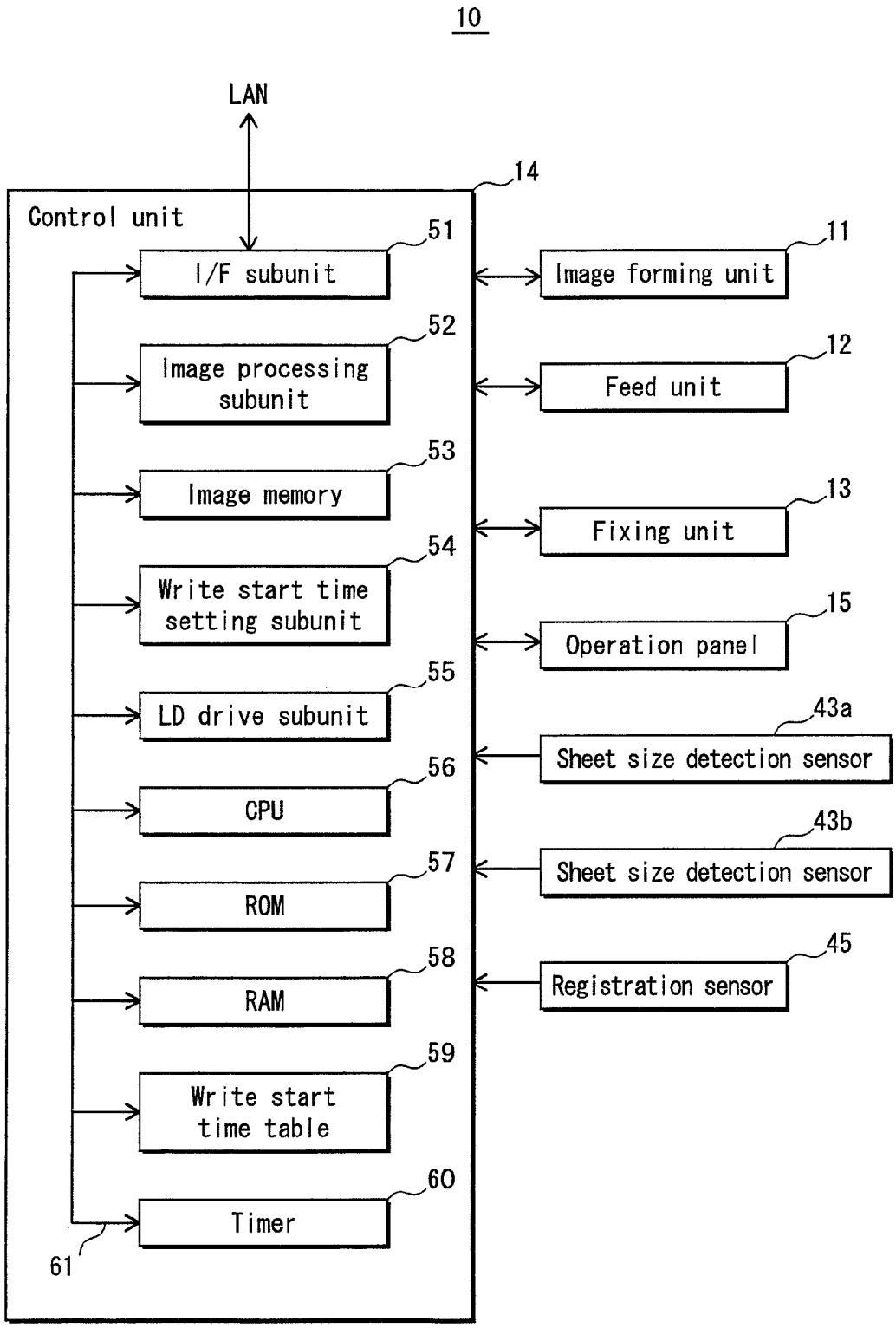
FIG. 2 is a block diagram showing the structure of a control unit included in the printer.

FIG. 2 is a block diagram showing the structure of the control unit 14.

As shown in FIG. 2, the control unit 14 includes a communication interface (I/F) subunit 51, an image processing subunit 52, image memory 53, a write start time setting subunit 54, a laser diode (LD) drive subunit 55, CPU 56, ROM 57, RAM 58, a write start time table 59, and a timer 60. These constituent elements can communicate with one another via a bus 61.

The communication I/F subunit 51 is an interface for connecting to a network, such as a LAN card and a LAN board. The communication I/F subunit 51 receives data on a print job from outside, and transmits the received data to the image processing subunit 52.

The image processing subunit 52 converts the data on the print job, which has been received from the communication I/F subunit 51, to pieces of image data for reproducing yellow, magenta, cyan and black images, respectively. The image processing subunit 52 causes the image memory 53 to store therein the converted pieces of image data.

The write start time setting subunit 54 sets, in one-to-one correspondence with different sheet sizes, write start times at which image writing starts is started on each of sheets S fed from the feed cassette 31*a*. To be more specific, assume, for example, a case where a standard write start time is a write start time at which image writing is started on a sheet S that is set in and fed from a lengthwise A3 section of the feed cassette 31*a* (namely, an A3 sheet) (i.e., a time that has been predetermined so that the front end of this A3 sheet S and the front end of a formed full-color image arrive at the secondary transfer position 37 at the same time). In this case, when the feed cassette 31*a* feeds a sheet S that is set in a crosswise A4 section thereof (namely, an A4 sheet), the write start time setting subunit 54 delays the write start time beyond the aforementioned standard write start time by a predetermined time period te. Note, when the feed cassette 31*b* feeds a sheet S, the write start time setting subunit 54 sets the standard write start time regardless of the sheet size of the sheet S.

When an A4 sheet is fed from the feed cassette 31*a*, the write start time is delayed in the above manner for the purpose of preventing misalignment between the frond end of a full-color image and the front end of the A4 sheet, the misalignment being caused by a sheet slip that occurs when rotation of the feed roller 33*a* is suspended during sheet transportation to prevent the above-described multiple transportation. The following explains the specific reason why the sheet slip occurs, with reference to FIGS. 3A to 3G.

FIG*s*. 3A to 3D illustrate how an A3 sheet is transported, while FIG*s*. 3E to 3G illustrate how an A4 sheet is transported. It should be noted that in FIGS. 3A to 3G, a reference number 40 denotes a pressed position in which the separator roller 34*a* is pressed against the feed roller 33*a*, and M denotes a distance from the pressed position 40 to the secondary transfer position 37 on the transfer path 48 (a transportation path length).

FIG. 3A shows how feeding of the A3 sheet is started. The A3 sheet is picked up from the feed cassette 31*a* due to the pickup roller 32*a*, the feed roller 33*a* and the separator roller 34*a* all rotating in the same direction. At this time, if more than one A3 sheets are simultaneously picked up, the separator roller 34*a* individually separates the more than one A3 sheets, and only the topmost A3 sheet is fed from the feed cassette 31*a* by the feed roller 33*a*. Once this piece of A3 sheet has been fed, it is transported to the pair of registration rollers 35 that are further downstream than the feed roller 33*a* in the transportation direction. The pair of registration rollers 35 are abeyant while the A3 sheet is being transported thereto.

FIG. 3B illustrates a curve 65 that is formed in the A3 sheet in the vicinity of its front end after its front end has arrived at the abeyant pair of registration rollers 35. After this curve 65 is formed, rotation of the pair of registration rollers 35 is started. As a result of starting the rotation of the pair of registration rollers 35, the A3 sheet is transported with the curve 65 still formed therein as shown in FIG. 3C.

Referring to FIG. 3D, the rotation of the feed roller 33*a* is suspended slightly before the rear end of the A3 sheet in the transportation direction passes the feed roller 33*a* (more specifically, when a certain portion of the A3 sheet has arrived at the pressed position 40, the certain portion being away from the rear end of the A3 sheet by the distance L in the transportation direction). As has been described before, the rotation of the feed roller 32*a* is suspended to prevent multiple transportation. Note, although the distance L is considered to be, for example, approximately 10 [mm] to 15 [mm], the distance L is preset to an appropriate value depending on variations of the lengths of sheets in the transportation direction (the sheet lengths), the speed of sheet transportation, etc. The timer 60 measures an amount of time to detect a time at which rotation of the feed roller 32*a* should be suspended, namely, a time at which the certain portion of the sheet, which is away from the rear end of the sheet by the distance L, arrives at the pressed position 40. Specifics of the timer 60 will be described later.

As a result of suspending the rotation of the feed roller 33*a*, transportation load is applied to the rear end of the A3 sheet. At the same time, as the A3 sheet is pulled toward the sheet transportation direction due to the rotation of the pair of registration rollers 35, the curve 65 is released, thus making the A3 sheet stretched to full length. At this moment, the largest transportation load is applied to the A3 sheet.

As shown in FIG. 3D, when the A3 sheet is used, the front end of the A3 sheet is located past the secondary transfer position 37 by the time the rotation of the feed roller 32*a* is suspended. Therefore, once the rotation of the feed roller 32*a* has been suspended, the A3 sheet is transported by the pair of registration rollers 35 and the secondary transfer roller 36. Therefore, the transportation load applied to the rear end of the A3 sheet is also applied to the pair of registration rollers 35 and the secondary transfer roller 36. This reduces the amount of load applied to each roller, thus preventing the sheet slip caused by the transportation load.

In contrast, when an A4 sheet is used, once feeding of the A4 has been started (FIG. 3E) and the curve 65 has been formed (FIG. 3F), the pair of registration rollers 35 start transporting the A4 sheet. When the rotation of the feed roller 33*a* has been suspended (FIG. 3G), the A4 sheet is transported only by the pair of registration rollers 35 as the front end of the A4 sheet is yet to arrive at the secondary transfer position 37. Therefore, the transportation load applied to the rear end of the A4 sheet is also applied to the pair of registration rollers 35. This causes the A4 sheet to slip due to the transportation load. When the sheet slip occurs, the front end of the A4 sheet arrives at the secondary transfer position 37 with delay that is equivalent to an amount of the sheet slip, and the front end of the A4 sheet is misaligned with the front end of a formed full-color image in the secondary transfer position 37 by an amount equivalent to the delay.

One possible way to prevent occurrence of this sheet slip is to increase, for example, the level of pressure between the pair of registration rollers 35 as much as possible. However, in reality, the higher the level of pressure between the pair of registration rollers 35, the stronger pressure the sheet is subjected to when passing through the pair of registration rollers 35, and the more it is likely that the sheet gets wrinkled or skewed. Also, it is important to mention that a roller is generally made from a metallic axial core on the circumferential surface of which an elastic member (e.g., rubber) is layered. Hence, increasing the level of pressure between rollers would result in a larger degree of deformation in their elastic members, application of a larger degree of load to the rollers, and decrease in durability of rollers. Put another way, increasing the level of pressure between rollers is an unpractical solution.

In view of the above, in a case where a sheet S is not transported by the secondary transfer roller 36 (i.e., the front end of the sheet S is yet to arrive at the secondary transfer position 37) by the time the rotation of the feed roller 33*a* is suspended, the image forming device of the present embodiment regards that sheet transportation will be delayed due to occurrence of the sheet slip, and thus delays a write start time beyond the standard write start time by a predetermined time period te that is equivalent to the delay in the sheet transportation caused by occurrence of the sheet slip.

It has been found from experiments that there is no drastic change in an amount of sheet slip (i.e., an amount by which a sheet slips through the pair of registration rollers 35) throughout the life of the image forming device, no matter how many years the image forming device is used. Herein, a time period equivalent to delay in sheet transportation caused by the sheet slip is calculated from experiments or the like in advance, and stored into the write start time table 59 as a delay time period te by which the write start time is to be delayed.

Given that the length of a sheet in the transportation direction (the sheet length) is P, whether or not the front end of the sheet has arrived at the secondary transfer position 37 by the time the rotation of the feed roller 32*a* is suspended can be judged based upon whether or not P is greater than or equal to (M+L). The image forming device judges in the affirmative when $P \geq (M+L)$, and judges in the negative when $P < (M+L)$. In the examples shown in FIG*s*. 3A to 3G, an A3 sheet corresponds to the case of $P \geq (M+L)$, whereas an A4 sheet corresponds to the case of $P < (M+L)$. Note, when the curve 65 is formed in a sheet and the sheet is transported along the outline of the curve 65, the transportation path length may be calculated assuming that the outline of the curve 65 is a part of the transportation path.

FIG. 4 shows contents of the write start time table 59.

As shown in FIG. 4, pieces of time information indicating write start times are written in the write start time table 59, in one-to-one correspondence with sheet sizes. By way of example, FIG. 4 shows the write start time table 59 in which a lengthwise A3 sheet corresponds to the standard write start time, and a crosswise A4 sheet corresponds to the time period te, which indicates that a write start time for the crosswise A4 sheet should be delayed from/behind the standard write start time by the time period te. The pieces of time information may be, for example, registered during a manufacturing process at a manufacturing factory, or set/changed by a service engineer or the like via the operation panel 15 after the image forming device is shipped from the manufacturing factory.

Returning to FIG. 2, the write start time setting subunit 54 reads out, from the write start time table 59, the write start time corresponding to the sheet size of a sheet to be used, and sets the write start time that has been read out (either the standard write start time or the time period te to be delayed) in the image forming device. At this time, the write start time that has been read out is set by the image forming device temporarily storing the piece of time information showing the write start time that has been read out. The write start time that has been read out may be set in a different manner.

When a sheet S is fed from the feed cassette 31*b*, transportation load is applied to the sheet S upon suspending rotation of the feed roller 33*b*. However, as has been explained above, when the sheet S is fed from the feed cassette 31*b*, the standard write start time is set in the image forming device regardless of the sheet size of the sheet S. This is because the sheet S fed from the feed cassette 31*b* is transported by both of the pair of transportation rollers 38 and the pair of registration rollers 35 by the time the rotation of the feed roller 33*b* is suspended, whether the sheet size of the sheet S is A3 or A4. Thus, even though transportation load is applied to the sheet S fed from the feed cassette 31*b* upon suspending the rotation of the feed roller 33*b*, the sheet S would not slip through the pair of registration rollers 35.

In accordance with the write start time set by the write start time setting subunit 54, the LD drive subunit 55 reads out, from the image memory 53, the pieces of image data for reproducing yellow, magenta, cyan and black images, respectively, and drives the laser diodes included in the exposure parts 3 of the image forming subunits 20Y, 20M, 20C and 20K.

ROM 57 stores therein a control program relating to image formation operations, etc. RAM 58 is used as a work area for CPU 56.

CPU 56 reads out a necessary program from ROM 57, and controls (i) processing of converting the pieces of image data, which is performed by the image processing subunit 52, (ii) processing of writing and reading out the pieces of image data into and from the image memory 53, and (iii) the aforementioned drive motors and electromagnetic clutches. CPU 56 starts or suspends rotation of each roller, such as the feed roller 33*a* and the pair of registration rollers 35, by performing the above controls. Furthermore, CPU 56 causes smooth execution of a print job by (i) causing the write start time setting subunit 54 to set a write start time and (ii) collectively controlling operations of the image forming unit 11, the feed unit 12, etc. at proper times.

Furthermore, by receiving the detection signals from the sheet size detection sensors 43*a* and 43*b*, CPU 56 can acknowledge sizes of sheets set in the feed cassettes 31*a* and 31*b* (acquisition of sheet sizes). Furthermore, by receiving the detection signal from the registration sensor 45, CPU 56 can acknowledge that the front end of a sheet has passed the detection position pertaining to the registration sensor 45.

(3) Control Performed by Control Unit 14 on Write Start Time

Figure 5A:
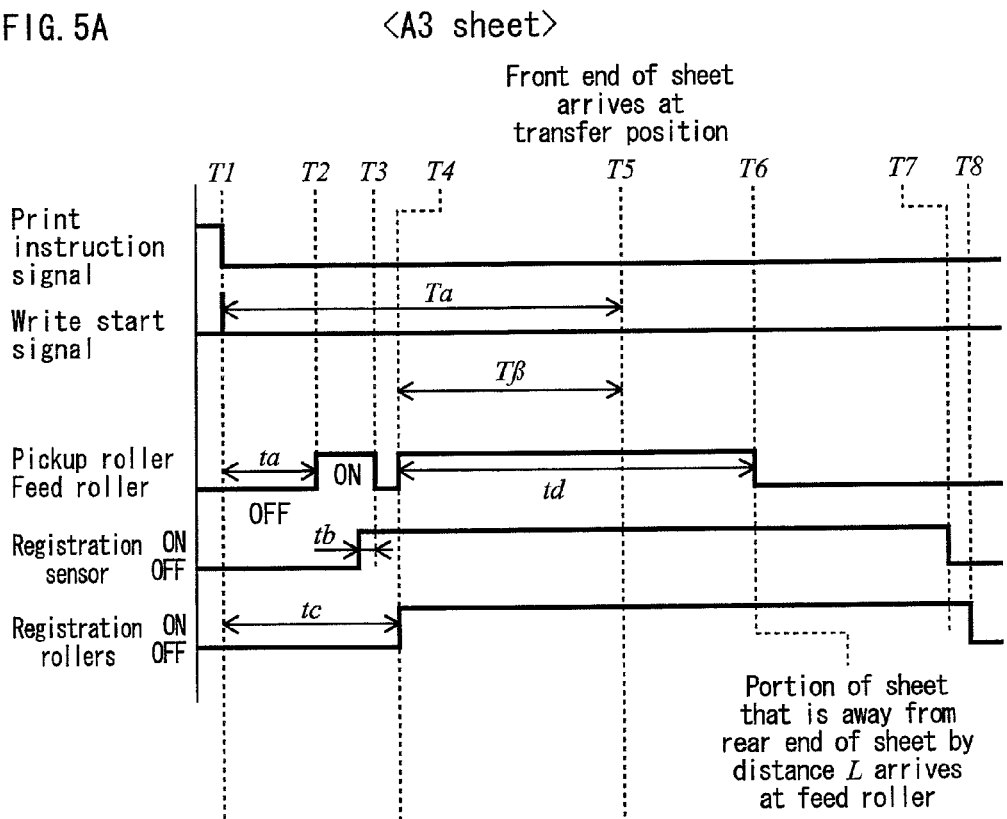
FIG. 5A is a time chart illustrating control performed on a write start time when the A3 sheet is fed from a feed cassette.
Figure 5B:
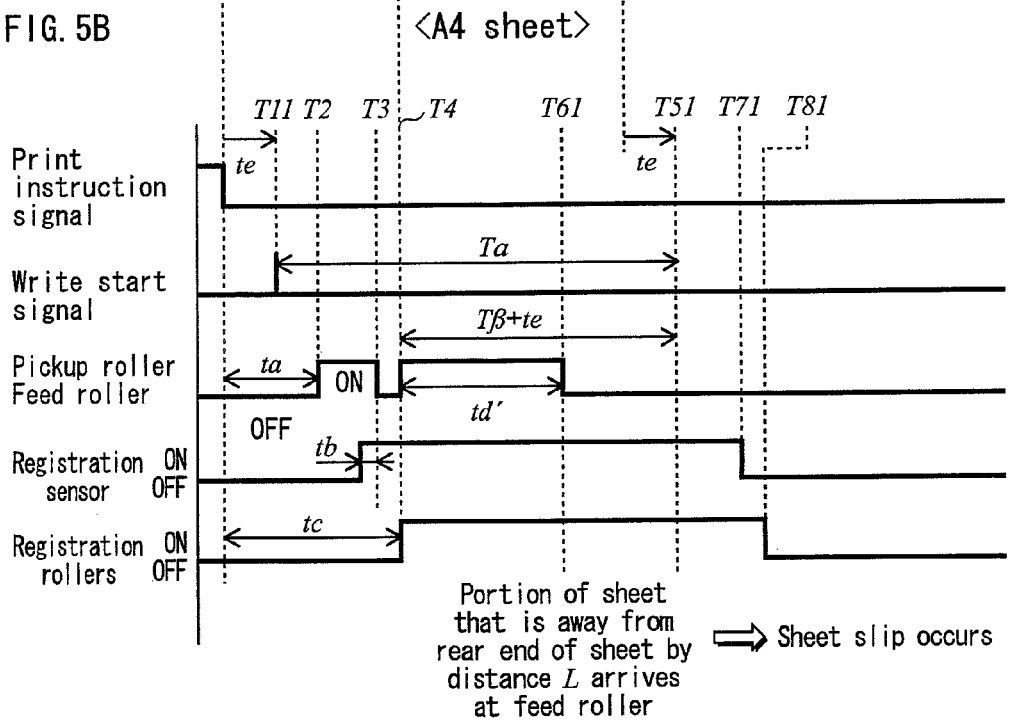
FIG. 5B is a time chart illustrating control performed on the write start time when the A4 sheet is fed from the feed cassette.

Each of FIGS. 5A and 5B is a time chart illustrating control performed on a write start time when a sheet is fed from the feed cassette 31*a*. By way of example, FIGS. 5A and 5B show cases where A3 and A4 sheets are fed, respectively.

(3-1) The Case of A3 Sheet

As shown in FIG. 5A, when a print instruction signal is input (time T1), a write start signal is turned on. The moment the write start signal is turned on, image writing is started, and the timer 60 is initiated to measure time periods ta to tg, which will be described later.

At time T2 (namely, when a predetermined time period ta has elapsed since the time T1), rotation of the pickup roller 32*a*, the feed roller 33*a* and the separator roller 34*a* is started. Consequently, an A3 sheet set in the feed cassette 31*a* is picked up from the feed cassette 31*a* by the pickup roller 32*a*, and the picked A3 sheet is fed by the feed roller 33*a* (FIG. 3A).

When a predetermined time period tb has elapsed since time T3 (namely, when the front end of the A3 sheet fed by the feed roller 33*a* passes the detection position pertaining to the registration sensor 45), rotation of the pickup roller 32*a*, the feed roller 33*a* and the separator roller 34*a* are suspended. The predetermined time period tb is obtained by adding (i) a time period Tp from (a) a time at which the front end of the A3 sheet passes the detection position pertaining to the registration sensor 45 to (b) a time at which the front end of the A3 sheet arrives at the position of the pair of registration rollers 35, and (ii) a time period Tr required to form a curve.

During the time period Tr, the front end of the A3 sheet comes to a halt while being stuck in between the pair of registration rollers 35. At this time, as the rear end of the A3 sheet is pushed toward the transportation direction by the pickup roller 32*a* and the feed roller 33*a*, the curve 65 is formed in the A3 sheet in the vicinity of its front end (FIG. 3B).

With the curve 65 formed in the A3 sheet, rotation of the pair of registration rollers 35, the pickup roller 32*a*, the feed roller 33*a* and the separator roller 34*a* is started at time T4 (namely, when a predetermined time tc, which is equivalent to the aforementioned time difference (Tα−Tβ), has elapsed since the time T1). Consequently, the A3 sheet is transported toward the secondary transfer position 37. Although it has been described above that the rotation of the feed roller 33*a* and the like is temporarily suspended between the times T3 and T4, the rotation of the feed roller 33*a* and the like may not be temporarily suspended depending on the length of the time period tc (e.g., in a case where a time at which the time period tc has elapsed coincides with the time T3).

The front end of the A3 sheet arrives at the secondary transfer position 37 at time T5 (namely, when the predetermined time period Tβ has elapsed since the time T4). The time T5 is also a time at which the predetermined time Tα has elapsed since the time T1, and a time at which the front end of the formed full-color image on the intermediate transfer belt 21 arrives at the secondary transfer position 37. As mentioned above, when the A3 sheet is used, the sheet slip caused by transportation load does not occur; therefore, the front end of the formed full-color image and the front end of the A3 sheet arrive at the secondary transfer position 37 at the same time.

This prevents misalignment between the formed full-color image and the A3 sheet in the transportation direction. The full-color toner image (the formed full-color image) on the intermediate transfer belt 21 is secondary-transferred onto the A3 sheet when the A3 sheet passes the secondary transfer position 37.

As the transportation of the A3 sheet progresses (FIG. 3C), the image forming device judges that a certain portion of the A3 sheet, which is apart from the rear end of the A3 sheet by the distance L, has arrived at the pressed position 40 between the separator roller 34*a* and the feed roller 33*a* at time T6 (namely, when a predetermined time td has elapsed since the time T4). Accordingly, at the time T6, the rotation of the pickup roller 32*a*, the feed roller 33*a* and the separator roller 34*a* is suspended (FIG. 3D). This prevents multiple transportation whereby more than one sheets are transported at a time.

Given that F is a distance on the transportation path 48 from a nip position 351 between the pair of registration rollers (FIGS. 3A to 3G) to the pressed position 40, the above predetermined time period td can be calculated in advance by using, for example, the equation td=(P−F−L)/V. Here, a sheet length P of the lengthwise A3 sheet is 420 [mm], whereas a sheet length P of the crosswise A4 sheet is 210 [mm]. Values of the distance F, the distance L and the speed V vary depending on the device structure. When a sheet having a different size (i.e., a sheet other than the A3 sheet) is used, the predetermined time period td can be calculated by using the above equation. Note, it is permissible to detect arrival of the certain portion of the sheet, which is away from the rear end of the sheet by the distance L, at the feed roller 33*a* by using a method different from the one descried above. Any method may be used to perform such detection, as long as the rotation of the feed roller 33*a* and the like is suspended when said certain portion of the sheet has arrived at the position of the feed roller 33*a*.

As the transportation of the A3 sheet further progresses, the rotation of the pair of registration rollers 35 is suspended at time T8 (namely, when a predetermined time period has elapsed since time T7 at which the rear end of the A3 sheet passes the registration sensor 45).

(3-2) The Case of A4 Sheet

As shown in FIG. 5B, when an A4 sheet is used, a write start signal is not turned on when a print instruction signal is input (the time T1). The write start signal is turned on at time T11, namely, when the predetermined time period te has elapsed since the time T1. This way, when the A4 sheet is used, a write start time is delayed beyond a write start time for the A3 sheet by the time period te.

Except for the fact that the write start time for the A4 sheet is delayed by the time period te, the operations performed between the times T1 and T4 when the A4 sheet is used are the same as those when the A3 sheet is used. In other words, between the times T1 and T4, the A4 sheet is fed from the feed cassette 31*a*, a curve is formed in the A4 sheet, and the pair of registration rollers 35 transport the sheet A4 toward the secondary transfer position 37 (FIGS. 3E and 3F).

The length of the A4 sheet in the transportation direction is shorter than that of the A3 sheet in the transportation direction. Hence, a certain portion of the A4 sheet, which is away from the rear edge of the A4 sheet by the distance L, arrives at the pressed position 40 earlier than said certain portion of the A3 sheet. In the example of FIG. 5B, the rotation of the feed roller 33*a* and the like is suspended at time T61, namely, when a predetermined time period td' has elapsed since the time T4 (FIG. 3G). Note, the predetermined time period td' can be obtained by calculating the aforementioned equation with a value 210 [mm] substituted into P (the length of the sheet in the transportation direction). The predetermined periods td and td' satisfy the relationship td'<td.

As has been described above, when the A4 sheet is used, the sheet slip occurs because transportation load is applied to the A4 sheet as a result of suspending the rotation of the feed roller 33*a*, etc. Therefore, the front end of the A4 sheet arrives at the secondary transfer position 37 with delay that is equivalent to an amount of such a sheet slip. An amount of this delay is equal to the time period te.

Considering that the write start time for the A3 sheet is the standard write start time, when the A4 sheet is used, the write start time is delayed by the time period te, and the front end of the A4 sheet arrives at the secondary transfer position 37 with delay due to occurrence of the sheet slip, the delay being equivalent to the time period te. Accordingly, the front end of the formed full-color image on the intermediate transfer belt 21 arrives at the secondary transfer position 37 with delay that is equivalent to the delay in arrival of the front end of the A4 sheet at the secondary transfer position 37 (time T51). As a result, both the front end of the formed full-color image and the front end of the A4 sheet arrive at the secondary transfer position 37 at the same time. This prevents misalignment between the formed full-color image and the A4 sheet in the transportation direction.

As the transportation of the A4 sheet progresses, the rotation of the pair of registration rollers 35 is suspended at time T81, namely, when a predetermined time period has elapsed since time T71 at which the rear end of the A4 sheet passes the registration sensor 45.

(3-3) Write Start Control

Figure 6:
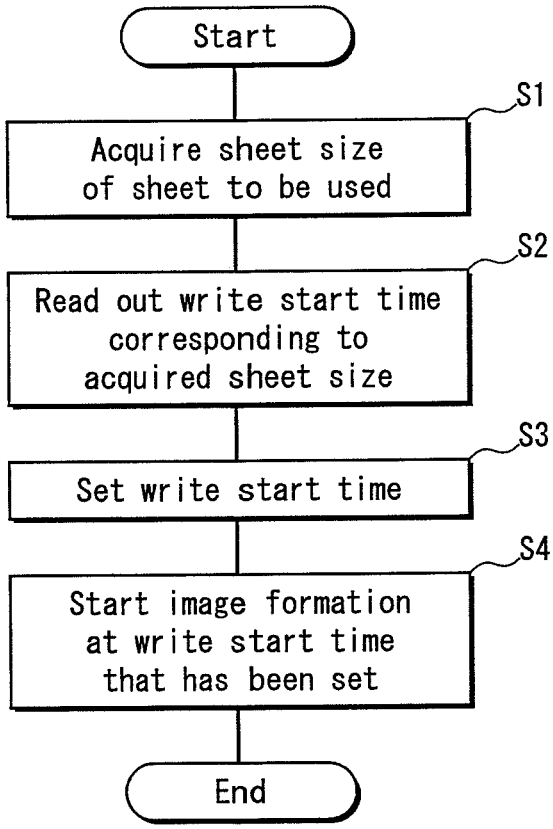
FIG. 6 is a flowchart of write start control performed by the control unit.

FIG. 6 is a flowchart of write start control that is performed by the control unit 14 on a time at which image writing is started when the feed cassette 31*a* has been selected.

As shown in FIG. 6, the control unit 14 acquires a sheet size of a sheet to be used, namely, a size of a sheet set in the feed cassette 31*a* (Step S1). More specifically, the control unit 14 performs this acquisition by receiving the detection signal from the sheet size detection sensor 43*a*.

The control unit 14 reads out, from the write start time table 59, the write start time corresponding to the acquired sheet size (Step S2), and sets the write start time that has been read out as the write start time at which image writing is to be started on the sheet set in the feed cassette 31*a* (Step S3). For instance, when an A3 sheet is set in the feed cassette 31*a*, the standard write start time is set. When an A4 sheet is set in the feed cassette 31*a*, the write start time is delayed beyond the standard write start time by the time period td.

The control unit 14 causes image formation to be started at the write start time that has been set in the above manner (Step S4), and terminates the processing of FIG. 6. In the above-described example, when an A3 sheet is used, the write start signal is turned on upon input of the print instruction signal as shown in FIG. 5A. On the other hand, when an A4 sheet is used, the write start signal is turned on when the time period td has elapsed since the input of the print instruction signal as shown in FIG. 5B.

As has been described above, in the image forming device of the present embodiment, a pair of transportation rollers are not located between the feed roller 33*a* and the pair of registration rollers 35. This structure allows downsizing of the image forming device. The image forming device may use sheets having various lengths in the transportation direction. When the image forming device uses a sheet whose length in the transportation direction causes delay in arrival of the front end of the sheet at the secondary transportation position 37 due to the sheet slipping through the pair of registration rollers 35 (i.e., a sheet that satisfies the relationship P<(M+

L)), the image forming device delays a write start time beyond the standard write start time by a time period equivalent to an amount of the delay in arrival of the front end of the sheet at the secondary transfer position 37, the delay being caused by occurrence of the sheet slip.

As a result of performing the above control, despite the fact that the front end of the sheet arrives at the secondary transfer position 37 with delay due to occurrence of the sheet slip, the front end of a formed full-color image still arrives at the secondary position 37 at the same time as the front end of the sheet. It is therefore possible to prevent misalignment between the formed full-color image and the sheet caused by occurrence of the sheet slip.

By way of example, it has been described above that the time periods Tα and Tβ satisfy the relationship Tα>Tβ (FIGS. 5A and 5B). However, as a magnitude relationship between P1, P2 and P3 may change depending on the device structure, there may be a case where the time periods Tα and Tβ satisfy the relationship Tα<Tβ. In case, when an A3 sheet is used as shown in FIG. 5A, the control unit performs the write start control so that the write start signal is turned on when a time difference (Tβ−Tα) has elapsed since rotation of the pair of registration rollers 35 was started, and the time when the write start signal is turned on is the standard write start time. Even when the time periods Tα and Tβ satisfy the relationship Tα<Tβ, the write start time for an A4 sheet (a time at which image writing is started on the A4 sheet) is still delayed beyond the standard write start time (a time at which image writing is started on an A3 sheet) by the predetermined time period te. Thus, as shown in FIG. 5B, when the A4 sheet is used, a time at which image writing is started on the A4 sheet is delayed, by the predetermine time period te, beyond the standard write start time at which image writing is started on the A3 sheet.

The present invention is not limited to being an image forming device, but may be an image forming method for controlling a write start time at which image writing is started, etc. Alternatively, the present invention may be a program that causes a computer to execute the above method. The program of the present invention may be recorded on a computer-readable recording medium such as a magnetic tape, a magnetic disk (e.g., a flexible disk), an optical recording medium (e.g., DVD-ROM, DVD-RAM, CR-ROM, CD-R, MO and PD), and a recording medium of a flash memory type. The program may be produced, sold, etc. after having been recorded on the above recording medium, or may be transmitted and provided in the form of a program via, for example, various types of wired/wireless networks (e.g., the Internet), broadcasting, telecommunication lines, and satellite communications. Furthermore, a part or all of predetermined processing may be executed using special-purpose hardware.

(4) Modification Examples

The present invention has been described above based on the embodiment thereof. However, it goes without saying that the present invention is not limited to being implemented based on the above embodiment. The present invention may be implemented based on the following modification examples.

(4-1) In the above embodiment, a write start time at which image writing is started on an A3 sheet is the standard write start time. A write start time at which image writing is started on an A4 sheet is delayed beyond the standard write start time by the predetermined time period te. However, a write start time may be controlled in a different manner. The image forming device may perform relative control on a formation start time (at which image formation is started) and a transportation start time (at which transportation of the sheet is started), in such a way that the following times (i) and (ii) coincide with each other, even if transportation of the sheet is delayed as a result of the sheet slipping through the pair of registration rollers 35, the sheet slip being attributed to the transportation load applied upon suspending rotation of the feed roller 33*a*: (i) a time at which the front end of a formed full-color image on the intermediate transfer belt 21 arrives at the secondary transfer position 37; and (ii) a time at which the front of the sheet arrives at the secondary transfer position 37.

For instance, the image forming device may always start image writing (image forming) at the standard write start time, and change a time at which rotation of the pair of registration rollers 35 is started (hereinafter, "a registration start time"). To be more specific, given that a standard registration start time is defined as a registration start time at which rotation of the pair of registration rollers 35 is started to transport an A3 sheet, the image forming device may perform time control in such a manner that, when an A4 sheet is used, rotation of the pair of registration rollers 35 is started earlier than the standard write start time by the predetermined time period te. Considering that arrival of the front end of the A4 sheet at the secondary transfer position 37 is delayed by the predetermined time period te as a result of the A4 sheet being subjected to the transportation load, the image forming device can advance a transportation start time at which the pair of registration rollers 35 start transporting the A4 sheet toward the secondary transfer position 37 by the predetermined time period te. This way, the front end of a formed full-color image on the intermediate transfer belt 21 and the front end of the A4 sheet arrive at the secondary transfer position 37 at the same time, even though the transportation of the A4 sheet is delayed.

Figures 7, 8:
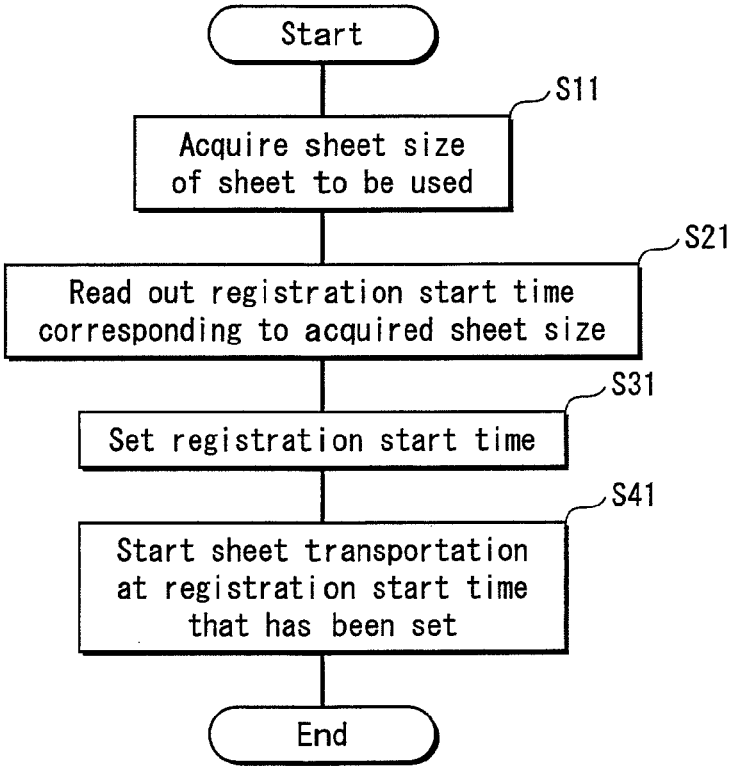
FIG. 7 shows contents of a registration start time table.
FIG. 8 is a flowchart of registration start control.

When the above structure is employed, for example, a registration start time table 591 shown in FIG. 7 is used. As shown in FIG. 7, a registration start time is written in the registration start time table 591 for each of A3 and A4 sheets. The registration start time table 591 shows that, in a case where the A4 sheet is used, the registration start time is advanced ahead of the standard registration start time (pertaining to a case where the A3 sheet is used) by the predetermined time period te.

Registration start control is illustrated in the flowchart of FIG. 8.

As shown in FIG. 8, the control unit 14 acquires the sheet size of the sheet to be used (Step S11). This acquisition is performed in the same manner as in the aforementioned Step S1.

The control unit 14 reads out, from the registration start timetable 591, the registration start time corresponding to the acquired sheet size (Step S21), and sets the registration start time that has been read out as the registration start time at which the sheet transportation by the pair of registration rollers 35 is started for the sheet of the acquired sheet size (Step S31). For instance, when an A3 sheet is set in the feed cassette 31*a*, the standard registration start time is set. When an A4 sheet is set in the feed cassette 31*a*, the registration start time is advanced ahead of the standard registration start time by the time period td.

The control unit 14 starts rotation of the pair of registration rollers 35 at the registration start time that has been set (Step S41), and terminates the processing of FIG. 8. As shown in FIG. 5B, in a case where the A4 sheet is used, the write start signal is turned on at the time T1 (the same as in a case where the A3 sheet is used), and the time T4 pertaining to the case where the A4 sheet is used becomes earlier than the time T4 pertaining to the case where the A3 sheet is used by the predetermined time period te.

Considering that the predetermined time period te, which is equivalent to an amount of delay in sheet transportation, needs to be adjusted in balance with the formation start time and the registration start time, the image forming device may change both of the formation start time and the registration start time with respect to a standard formation start time and the standard registration start time, respectively. To be more specific, when the relationship $te=\alpha+\beta$ is satisfied (with $\alpha$ and $\beta$ respectively satisfying the relationships $\alpha>0$ and $\beta>0$), the same effect can be obtained if the formation start time is delayed by $\alpha$ and the registration start time is advanced by $\beta$.

The formation start time has been described as, but is not limited to, a time at which the exposure part 3 starts the exposure (image writing) on the photosensitive drum 1. If the image forming device is structured so that the front end of a formed full-color image arrives at the transfer position at various times depending on to an operation of a certain image forming process (in the above example, the exposure) starting at various times, then the formation start time may be defined as a time at which the certain image forming process is started.

(4-2) By way of example, the above has described cases where a lengthwise A3 sheet and a crosswise A4 sheet are used. However, it goes without saying that the image forming device may use a sheet whose size is neither the lengthwise A3 nor the crosswise A4. When the image forming device uses a sheet whose sheet length P satisfies the aforementioned relationship $P<(M+L)$, the image forming device performs time control so that (i) a formation start time is delayed beyond a standard formation start time by a predetermined time period, and/or (ii) a registration start time is advanced ahead of the standard registration start time by the predetermined time period.

The predetermined time period to has been described as, but is not limited to, a time period equivalent to an amount of delay in arrival of a sheet at the secondary transfer position 37, the delay being caused by the sheet slipping through the pair of registration rollers 35. For instance, assume a case where misalignment between a formed full-color image and the sheet is permissible as long as a human being does not consider the misalignment as deterioration in image quality when seeing the misalignment with his/her eyes. In this case, if misalignment between the formed full-color image and the sheet is permissible when it falls within a range between, for example, −0.5 [mm] to +0.5 [mm] (with 0 [mm] denoting no misalignment between the formed full-color image and the sheet), the image forming device may set the predetermined time period te to any value included in the aforementioned range, whether it be longer or shorter than a time period equivalent to the amount of delay in the sheet transportation caused by occurrence of the sheet slip. Note, if it is known in advance that an amount of sheet slip increases over time, even if only slightly, then the predetermined time period te may be set to the smallest value of the aforementioned range on purpose.

(4-3) It has been described above that a sheet size is acquired from a result of detection performed by the sheet size detection sensor 43*a*. However, the sheet size may be acquired in a different manner. For example, if the image forming device is structured to allow a user to register sheet sizes of sheets set in the feed cassettes 31*a* and 31*b* via a registration screen or the like on the operation panel 15, then the image forming device may store information on the registered sheet sizes so it can acquire the sheet sizes by reading the stored information.

It has been described above that the image forming device judges whether a sheet (in the above example, an A4 sheet) satisfies the relationship $P<(M+L)$ based on the sheet size thereof. However, the image forming device may make this judgment using a different method. For example, the image forming device may further comprise a sensor or the like that can detect a sheet length P itself. In this case, the image forming device judges whether the sheet satisfies the relationship $P<(M+L)$ based on the detected sheet length P.

(4-4) It has been described in the above embodiment that the curve 65 is formed in a sheet. However, the present invention can be also applied to, for example, a case where such a curve 65 is not formed in the sheet. This is because even if such a curve 65 is not formed in the sheet, the sheet may still slip through the pair of registration rollers 35 due to the sheet being subjected to transportation load upon suspending rotation of the feed roller 33*a*.

It has been described that the above-described control (e.g., delaying a write start time) is not performed on a sheet fed from the feed cassette 31*b*, because existence of the pair of transportation rollers 38, which are located between the feed roller 33*b* and the pair of registration rollers 35, makes it unlikely that the sheet slip occurs due to the transportation load. However, in a case where a sheet having a certain size is still subjected to the sheet slip even through it is fed from the feed cassette 31*b* and the pair of transportation rollers 38 are provided, the image forming device may similarly perform the above-described control on this sheet.

(4-5) As one example, it has been described in the above embodiment that the image forming device of the present invention is applied to a tandem digital color printer. However, the present invention may be applied to any general image forming device that can transfer an image formed on an image carrier onto a sheet in a transfer position, whether it is a color, monochrome or tandem image forming device. Examples of such a general image forming device include a photocopier, a facsimile machine and a multifunction peripheral (MFP).

More specifically, the present invention may be applied to, for example, a monochrome image forming device that forms an image on a photosensitive drum that serves as an image carrier, and transfers the formed image onto a sheet fed from a feed unit in a transfer position. The present invention may also be applied to, for example, an image forming device of a transfer drum type that performs the following processing: forming toner images of different colors on a single photosensitive drum in sequence; each time a transfer drum is rotated by 360 degrees, transferring a different one of the formed toner images onto the transfer drum in a primary transfer position, so that the formed toner images are multiple-transferred onto the transfer drum; and secondary-transferring the toner images, which have been multiple-transferred onto the transfer drum, onto a sheet in a secondary transfer position. This image forming device of the transfer drum type may also be structured to regard that a formation start time is a time at which the exposure (image writing) is started on the photosensitive drum, so that the image forming device can (i) delay the write start time beyond a standard write start time by a predetermined time period, and/or (ii) advance transportation of the sheet to the secondary transfer position ahead of a standard transportation start time by a predetermined time period.

According to the above embodiment, the image forming device is structure to form images on the photosensitive drums 1, primary-transfer the images formed on the photosensitive drums 1 onto the intermediate transfer belt 21, and secondary-transfer the images that have been primary-transferred onto the intermediate transfer belt 21 onto a sheet in the secondary transfer position 37. Here, both of the photosensitive drums 1 and the intermediate transfer belt 21 may be considered as image carriers. Or, only the intermediate transfer belt 21 may be considered as an image carrier. In this case, the formation start time is a time at which a yellow toner image is primary-transferred from the corresponding photosensitive drum 1 to the intermediate transfer belt 21. This formation start time is equivalent to the write start time at which image writing is started on the photosensitive drum 1 included in the image forming subunit 20Y.

The image carrier may be shaped in the form of a drum, a belt, or other objects. Furthermore, although the above embodiment has described, by way of example, a case where the separator roller 34*a* is used as a separator, the separator roller 34*a* is not limited to having a shape of a roller, as long as it is a member that is pressed against the feed roller 33*a* and separates sheets individually; the separator roller 34*a* may be shaped in the form of a pad, a belt, etc. Similarly, the feed roller 33*a* may be replaced by, for example, a rotating member that feeds a sheet and is shaped in the form of a belt.

Furthermore, although it has been described above, by way of example, that the image forming device comprises the pickup roller 32*a*, the image forming device may not comprise the pickup roller 32*a*. In this case, the image forming device may comprise a feed roller 33*a* that also functions as a pickup roller. Furthermore, although it has been described above, by way of example, that the feed cassette 31*a* is used as a container that contains sheets, the container is not limited to being a cassette, but may be a container of any form as long as it can contain sheets.

The present invention may be implemented based on any combination of the above embodiment and modification examples.

Conclusion

The above embodiment and modification examples represent aspects of the present invention that solve the problems mentioned earlier in "(2) Description of the Related Art". The above embodiment and modification examples are summarized as follows.

One aspect of the present invention is an image forming device that forms an image on a rotating image carrier, comprising: a feeder operable to cause (i) a sheet to pass between a first rotating member for feeding the sheet and a separator pressed against the first rotating member in a pressed position, and (ii) a pair of second rotating members to transport the sheet fed from the first rotating member with the sheet held therebetween; a third rotating member that (i) is pressed against the image carrier in a transfer position, (ii) transports the sheet that has been transported from the pair of second rotating members, with the sheet held between the third rotating member and the image carrier, and (iii) transfers the image formed on the image carrier onto the sheet; a first controller operable to relatively control time when the image formation is started and time when the pair of second rotating members start the sheet transport toward the transfer position; and a second controller operable, during the sheet transport, to suspend rotation of the first rotating member when a portion of the sheet passes the pressed position, the portion of the sheet being away from a rear end of the sheet by a predetermined distance L, wherein provided that a length of a first sheet size in a transport direction is grater than or equal to a length (M+L), where M is a distance from the pressed position to the transfer position on a transport path, and a length of a second sheet size in the transport direction is smaller than the length (M+L), when the sheet has the second sheet size, the first controller at least one of (i) delays the start of the image formation and (ii) advances the start of the sheet transport, by a predetermined time period as compared to when the sheet has the first sheet size.

A second aspect of the present invention is the image forming device of the first aspect, wherein when a curve formation time period has elapsed since arrival of a front end of the sheet fed by the first rotating member at the pair of second rotating members that are abeyant, the first controller rotates the pair of second rotating members to start the sheet transport toward the transfer position, the curve formation time period being a time period required to form a predetermined curve in the sheet in a vicinity of the front end thereof.

A third aspect of the present invention is the image forming device of the first aspect, wherein in a case where the first controller only one of (i) delays the start of the image formation and (ii) advances the start of the sheet transport when the sheet has the second sheet size, the predetermined time period is equivalent to a time period by which arrival of the front end of the sheet at the transfer position is delayed as a result of the sheet being subjected to transport load and thus slipping through the pair of second rotating members, the transport load arising from pressure between the first rotating member and the separator upon suspending the rotation of the first rotating member during the sheet transport.

A fourth aspect of the present invention is the image forming device of the third aspect, further comprising storage that stores therein information showing the predetermined time period, wherein the first controller acquires the predetermined time period by reading out the information from the storage.

A fifth aspect of the present invention is the image forming device of the first aspect, further comprising a detector operable to detect a sheet size of the sheet fed by the first rotating member, wherein the first controller judges whether or not the sheet has the second sheet size in accordance with a result of the detection performed by the detector.

A sixth aspect of the present invention is an image forming method used in an image forming device that forms an image on a rotating image carrier, the method comprising: a first step of causing (i) a sheet to pass between a first rotating member for feeding the sheet and a separator pressed against the first rotating member in a pressed position, and (ii) a pair of second rotating members to transport the sheet fed from the first rotating member with the sheet held therebetween; a second step of (i) transporting the sheet that has been transported from the pair of second rotating members, with the sheet held between a third rotating member pressed against the image carrier in a transfer position and the image carrier, and (ii) transferring the image formed on the image carrier onto the sheet; a third step of relatively controlling time when the image formation is started and time when the pair of second rotating members start the sheet transport toward the transfer position; and a fourth step of, during the sheet transport, suspending rotation of the first rotating member when a portion of the sheet passes the pressed position, the portion of the sheet being away from a rear end of the sheet by a predetermined distance L, wherein provided that a length of a first sheet size in a transport direction is grater than or equal to a length (M+L), where M is a distance from the pressed position to the transfer position on a transport path, and a length of a second sheet size in the transport direction is smaller than the length (M+L), when the sheet has the second sheet size, the third step at least one of (i) delays the start of the image formation and (ii) advances the start of the sheet transport, by a predetermined time period as compared to when the sheet has the first sheet size.

A seventh aspect of the present invention is the image forming method of the sixth aspect, wherein when a curve formation time period has elapsed since arrival of a front end of the sheet fed by the first rotating member at the pair of second rotating members that are abeyant, the third step rotates the pair of second rotating members to start the sheet transport toward the transfer position, the curve formation time period being a time period required to form a predetermined curve in the sheet in a vicinity of the front end thereof.

An eighth aspect of the present invention is the image forming method of the sixth aspect, wherein in a case where the third step only one of (i) delays the start of the image formation and (ii) advances the start of the sheet transport when the sheet has the second sheet size, the predetermined time period is equivalent to a time period by which arrival of the front end of the sheet at the transfer position is delayed as a result of the sheet being subjected to transport load and thus slipping through the pair of second rotating members, the transport load arising from pressure between the first rotating member and the separator upon suspending the rotation of the first rotating member during the sheet transport.

A ninth aspect of the present invention is the image forming method of the eighth aspect, wherein the third step acquires the predetermined time period by reading out information showing the predetermined time period from storage in which the information is stored.

A tenth aspect of the present invention is the image forming method of the sixth aspect, wherein the third step judges whether or not the sheet has the second sheet size in accordance with a result of the detection performed by a detector that detects a size of the sheet fed by the first rotating member.

As described above, in the case where the sheet has the second sheet size, the image forming device (i) delays the start of the image formation and/or (ii) advances the start of the sheet transport, by the predetermined time period as compared to when the sheet has the first sheet size. In the case where the sheet has the second sheet size, the above structures enable the front end of the formed image and the front end of the sheet to arrive at the transfer position at the same time, even if the front end of the sheet arrives at the transfer position with delay due to the sheet slipping through the pair of second rotating members, the sheet slip being attributed to suspension of rotation of the first rotating member. Accordingly, the above structures can prevent misalignment between the front end of the formed image and the front end of the sheet having the second size in the transfer direction.

Industrial Applicability

An image forming device of the present invention is beneficial in that it can be manufactured small, and cause a front end of an image formed on an image carrier and a front end of a transported sheet to coincide with each other in a transfer position.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device that forms an image on a rotating image carrier, comprising:

a feeder operable to cause a sheet to pass between a first rotating member for feeding the sheet and a separator pressed against the first rotating member in a pressed position, and a pair of second rotating members to transport the sheet fed from the first rotating member with the sheet held therebetween;

a third rotating member that is pressed against the image carrier in a transfer position, transports the sheet that has been transported from the pair of second rotating members, with the sheet held between the third rotating member and the image carrier, and transfers the image formed on the image carrier onto the sheet;

a first controller operable to relatively control timing when the image formation is started and timing when the pair of second rotating members start the sheet transport toward the transfer position; and a second controller operable, during the sheet transport, to suspend rotation of the first rotating member when a portion of the sheet passes the pressed position, the portion of the sheet being away from a rear end of the sheet by a predetermined distance L, wherein provided that a length of a first sheet size in a transport direction is greater than or equal to a length (M+L), where M is a distance from the pressed position to the transfer position on a transport path, and a length of a second sheet size in the transport direction is smaller than the length (M+L), the first controller determines whether the sheet has the first sheet size or the second sheet size, and in response to the first controller determining that the sheet has the second sheet size, the first controller performs at least one of delaying the start of the image formation and advancing the start of the sheet transport, by a predetermined time period as compared to when the sheet has the first sheet size.

2. The image forming device of claim 1, wherein when a curve formation time period has elapsed since arrival of a front end of the sheet fed by the first rotating member at the pair of second rotating members that are abeyant, the first controller rotates the pair of second rotating members to start the sheet transport toward the transfer position, the curve formation time period being a time period required to form a predetermined curve in the sheet in a vicinity of the front end thereof.

3. The image forming device of claim 1, wherein in a case where the first controller performs only one of delaying the start of the image formation and advancing the start of the sheet transport when the sheet has the second sheet size, the predetermined time period is equivalent to a time period by which arrival of the front end of the sheet at the transfer position is delayed as a result of the sheet being subjected to transport load and thus slipping through the pair of second rotating members, the transport load arising from pressure between the first rotating member and the separator upon suspending the rotation of the first rotating member during the sheet transport.

4. The image forming device of claim 3, further comprising storage that stores therein information showing the predetermined time period, wherein the first controller acquires the predetermined time period by reading out the information from the storage.

5. The image forming device of claim 1, further comprising a detector operable to detect a sheet size of the sheet fed by the first rotating member, wherein the first controller judges whether or not the sheet has the second sheet size in accordance with a result of the detection performed by the detector.

* * * * *